US006280064B1

(12) United States Patent
Sato et al.

(10) Patent No.: US 6,280,064 B1
(45) Date of Patent: Aug. 28, 2001

(54) VEHICLE SIGNAL LAMP

(75) Inventors: Osamu Sato; Kazunori Natsume, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/170,720

(22) Filed: Oct. 14, 1998

(30) Foreign Application Priority Data

Oct. 14, 1997 (JP) ..... 9-296255

(51) Int. Cl.[7] ..... F21V 7/00; F21V 1/16

(52) U.S. Cl. ..... 362/348; 362/257; 362/291; 362/297; 362/317; 362/346; 362/459; 362/487; 362/507; 362/516; 362/517; 362/518; 362/519; 362/520; 362/521; 362/522

(58) Field of Search ..... 362/257, 291, 362/297, 317, 346, 348, 459, 487, 507, 516–522

(56) References Cited

U.S. PATENT DOCUMENTS 3,758,770 * 9/1973 Morasz ..... 240/41.36
5,556,194 9/1996 Natsume et al. ..... 362/299
5,582,481 12/1996 Natsume ..... 362/336
5,599,085 * 2/1997 Tabata et al. ..... 362/72

* cited by examiner

*Primary Examiner*—Audrey Chang
*Assistant Examiner*—Craig Curtis
(74) *Attorney, Agent, or Firm*—Sughrue, Mion, Zinn, Macpeak & Seas, PLLC

(57) ABSTRACT

The reflective surface of a reflector 16 is divided through steps into a plurality of vertically elongated reflective surface elements. In each of those reflective surface elements, the light incidence section to which the output light of a light source bulb is applied is made up a convex cylindrical curved surface and a concave cylindrical curved surface which are arranged substantially in parallel with the step adjacent to the light incidence section. Accordingly, when the lamp is turned on, and the reflector is observed from the front, the light incidence sections function as follows; that is, the apex portions of the cylindrical curves surfaces look glittered as bright sections. Therefore, the reflective surface looks more sparkling.

20 Claims, 9 Drawing Sheets

VEHICLE SIGNAL LAMP

BACKGROUND OF THE INVENTION

1. Technical Field of the Invention

The present invention relates to a vehicle signal lamp having a reflector, a reflective surface of which is formed with a plurality of reflective surface elements.

2. Related Art

In a recent vehicle, a so-called "step reflector" has been popularly employed in which a plurality of reflective surface elements are formed on the reflective surface thereof.

As shown in FIG. 9, a step reflector 6 is provided with a reflective surface which is divided into a plurality of reflective surface elements 6*s* by steps 4 formed therebetween. Those reflective surface elements 6*s* are curved to reflect the light beam from a light source bulb in a diffusion mode.

In the above-described step reflector 6, the reflective surface elements 6*s* forming the reflective surface 6*a* are all of one and the same curved surface. Therefore, as shown in FIG. 10, when, after the lamp is turned on, the step reflector 6 is observed from the front, each of the reflective surface elements 6*s* looks as follows: only the substantially apex portion of the curved surface looks bright as a bright portion Br'.

Hence, in the reflective surface 6*a*, the distance between the bright portions Br' is long, so that the reflective surface 6*a* does not sufficiently glisten. Hence, when the lamp is turned on, the latter looks unattractive.

SUMMARY OF THE INVENTION

In view of the foregoing, an object of the invention is to provide a vehicle signal lamp with a step reflector which looks attractive when turned on.

The foregoing object of the invention has been achieved by a provision of a vehicle signal lamp having a reflector which is divided into a plurality of reflective surface elements, and in each of the reflective surface elements, the light incidence sections which receive light beam from a light source bulb is constituted by a plurality of curved surfaces.

More specifically, the foregoing object of the invention has been achieved by the provision of a vehicle signal lamp having a light source bulb, and a reflector for reflecting light from the light source bulb forwardly; in which, according to the invention, at least a part of the reflective surface of the reflector is divided into a plurality of reflective surface element through steps, and in each of the reflective surface elements, a light incidence section to which light from the light source bulb is applied is made up of a plurality of curved surfaces.

It goes without saying that the region that is "divided into a plurality of reflective surface elements through steps" may be a region which is over the whole reflective surface in one example; however, it may be a part of the reflective surface.

The "reflective surface elements" are not particularly limited in configuration as long as they are divided through the steps. For instance, they may be rectangular being formed by dividing the reflective surface in the form of matrix, or may be belt-shaped being formed by dividing it in the form of stripes, or may be in the form of loops being formed by dividing it coaxially. The width of the reflective surface elements is not particularly limited; that is, for instance, it may be of a constant pitch, or of a gradually changing pitch, or of a random pitch.

The steps may be formed so as to rise toward the optical axis, or away from the optical axis. In the former case, when the lamp is turned on, because of the steps the shades are often formed on the reflective surface elements on the side opposite to the optical axis side. In this case, a certain region of the reflective surface elements becomes light incidence section. On the other hand, in the latter case, when the lamp is turned on, the steps form no shades, and therefore the whole region of the reflective surface elements is the light incidence section.

The arrangement of the plurality of curved surfaces, and the configuration and section of those curved surfaces, are not particularly limited.

In addition, the parts of the reflective surface elements other than the light incidence sections are not particularly limited in sectional configuration.

As was described above, in the vehicle signal lamp of the invention, the reflective surface of the reflector is divided into a plurality of reflective surface elements through the steps, and in each of the reflective surface elements, the light incidence section to which the output light of the light source bulb is applied is made up of a plurality of curved surfaces. Therefore, when the lamp is observed from front which is turned on, the light incidence sections look glittered with the apexes of the plurality of curved surfaces as bright sections. Owing to this feature, it is possible to decrease the distance between the bright sections in the reflective surface, and therefore the reflective surface appears glittered. Not only when the lamp is observed from front, but also when the lamp is observed obliquely, the reflective surface appears glittered.

According to the invention, the marker lamp with the step reflector looks more attractive when turned on.

As was described above, the arrangement of the plurality of curved surfaces forming the light incidence sections is not particularly limited. If the plurality of curved surfaces are arranged substantially in parallel with the steps adjacent to the light incidence sections, then when the lamp is turned on, the bright sections of the plurality of curved surfaces look bright as a repetitive pattern over the plurality of reflective surface elements. Hence, the lamp looks more attractive when turned on. Furthermore, in the case of the reflective surface in which the shaded portions are formed by the above-described steps, when the lamp is turned on, the configuration of the shaded portions is emphasized by the bright sections of the plurality of curved surfaces. Therefore, the shaded portions make the reflective surface more attractive in design.

Furthermore, in the case where the plurality of curved surfaces forming each of the light incidence sections are convex curved surfaces and concave curved surfaces which are arranged alternately, then when the lamp is observed in a different direction, the distance between the bright section of the concave curved surface and the bright section of the convex curved surface. Therefore, the resultant lamp is novel in design. In this case, the junction of the concave curved surface and convex curved surface may be made smooth with ease. Accordingly, when the lamp is not turned on, the light incidence sections look integral with one another, which makes it possible that, when the lamp is not turned on, the lamp looks more attractive in design.

In general, an object looks large which is located near the observer, and an object looks small which located far from the observer. Furthermore, in the case where a plurality of objects are arranged at equal intervals, the objects located near the observer look sparse, while the objects located far from the observer look abundant. A rule of linear perspective is known as a method of perspective drawing based on the above-described visual action. Therefore, if each of the light incidence sections is gradually larger in width as the light incidence section comes apart from the optical axis of the reflector, then because of a rule of perspective, the part of the reflective surface which is located near the optical axis looks farthest from the observer. Hence, the reflective surface looks deeper than its actual depth. Therefore, the lamp looks more attractive in design.

In the case, too, where each of shaded portions formed between the light incidence sections is gradually larger in width as the shaded portion comes apart from the optical axis of the reflector, owing to the above-described rule of perspective the same effect is obtained.

BRIEF DESCRIPTION OF THE DRAWING(S)

FIG. 7 is a front view showing bright sections observed when the light source bulb of the vehicle signal lamp is turned on;

DESCRIPTION OF THE PREFERRED EMBODIMENTS

An embodiment of the invention will be described with reference to the accompanying drawings.

Figure 1:
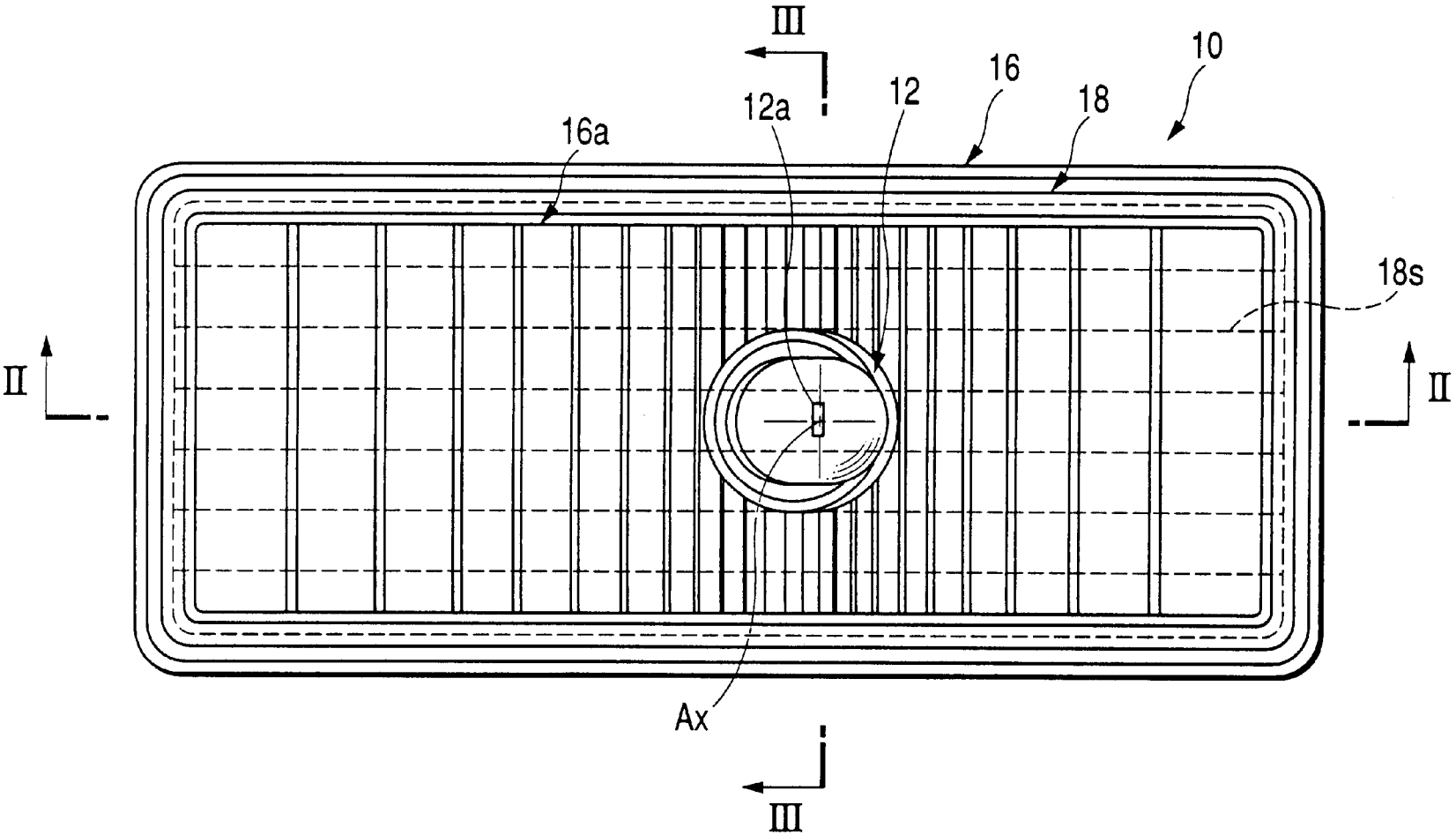
FIG. 1 is a front view of a vehicle signal lamp according to an embodiment of the invention.
Figure 2:
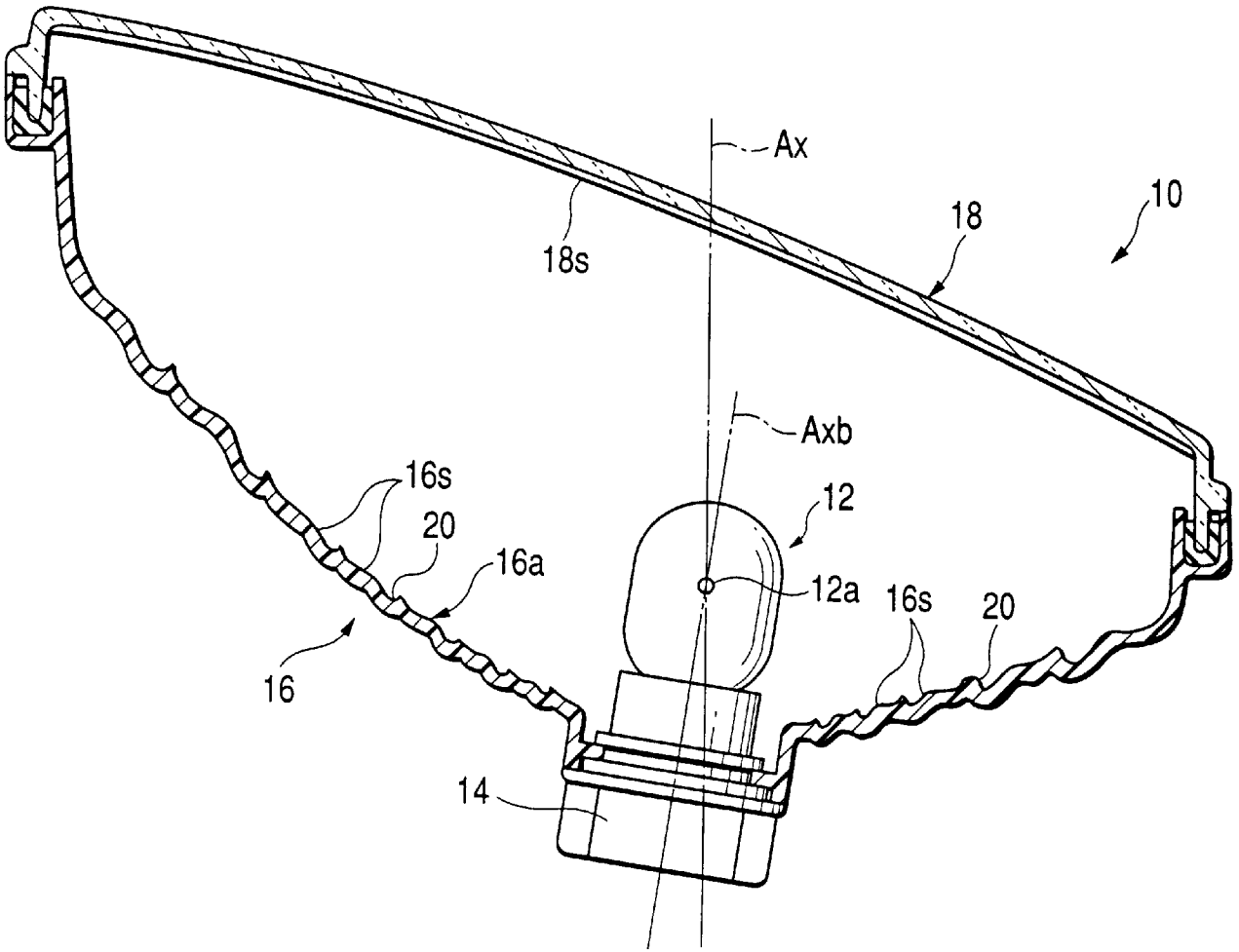
FIG. 2 is a sectional view taken along line II—II in FIG. 1.
Figure 3:
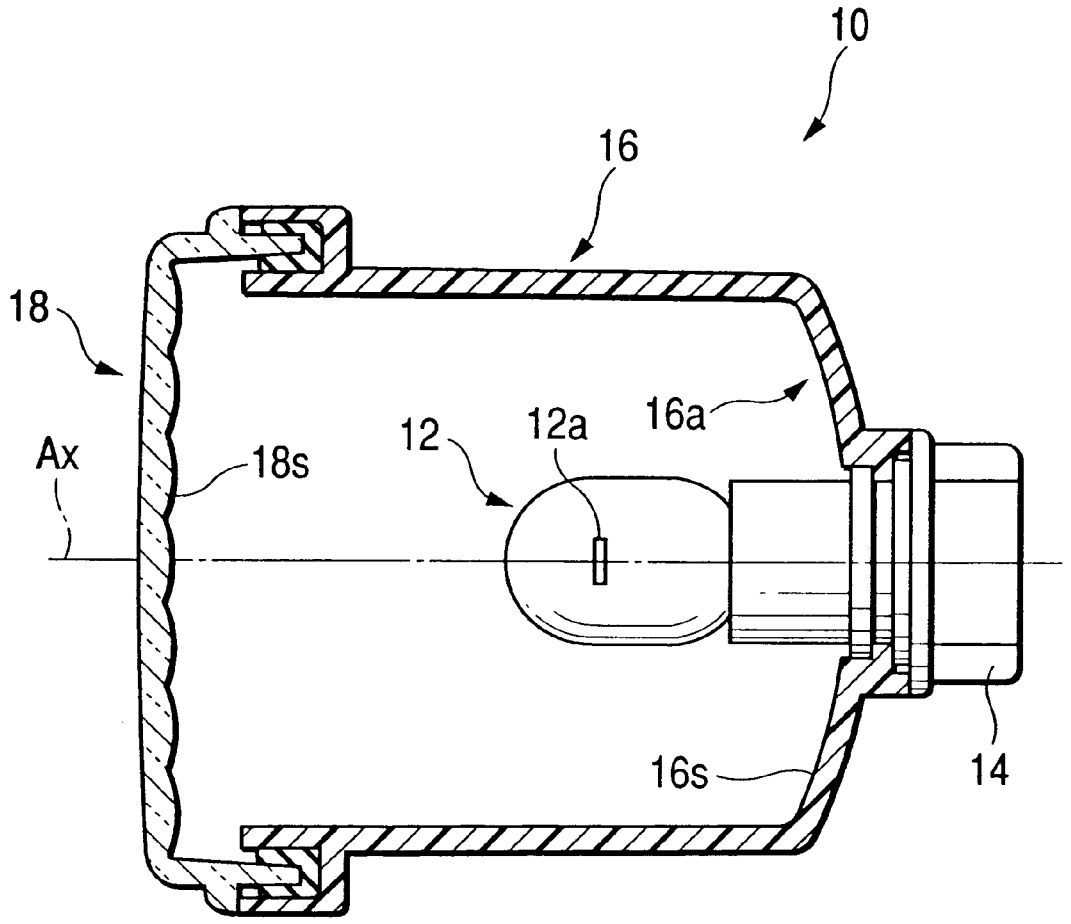
FIG. 3 is a sectional view taken along line III—III in FIG. 1.

FIG. 1 is a front view of a vehicle signal lamp, which constitutes an embodiment of the invention. FIG. 2 is a sectional view taken along line II—II in FIG. 1, and FIG. 3 is a sectional view taken along line III—III in FIG. 1.

As shown in those figures, the marker lamp (hereinafter referred to merely as "a lamp", when applicable) 10, the embodiment of the invention, is a tail lamp provided on the right side rear end of the vehicle body, and comprises: a light source bulb 12 having a filament 12*a* which is extended vertically; a reflector 16 having a reflective surface 16*a* which horizontally reflects the light beam from the light source bulb 12 forwardly (of the lamp; i.e., backwardly of the vehicle body) in a diffusion mode; and a lens 18 which is arranged in front of the reflector 16 and secured to the latter 16. The lamp is rectangular, being horizontally longer.

The light source bulb 12 is engaged with the reflector 16 in such a manner that its optical axis Axb is slightly inclined outwardly as viewed in a direction of vehicle width with respect to the optical axis Ax of the reflector 16 which extends in a front-to-rear direction of the vehicle, and that its filament 12*a* is on the aforementioned optical axis Ax.

The surface configuration of the lens 18 is horizontally inclined with its right end portion retracted. A plurality of lens steps 18*s* are formed in the inner surface of the lens 18. Those lens steps 18*s* are convex cylindrical lens steps which are equal in vertical pitch to one another and extend horizontally. With the aid of those lens steps 18*s*, the light reflecting from the reflective surface 16*a* passes through while being diffused vertically.

Figure 4:
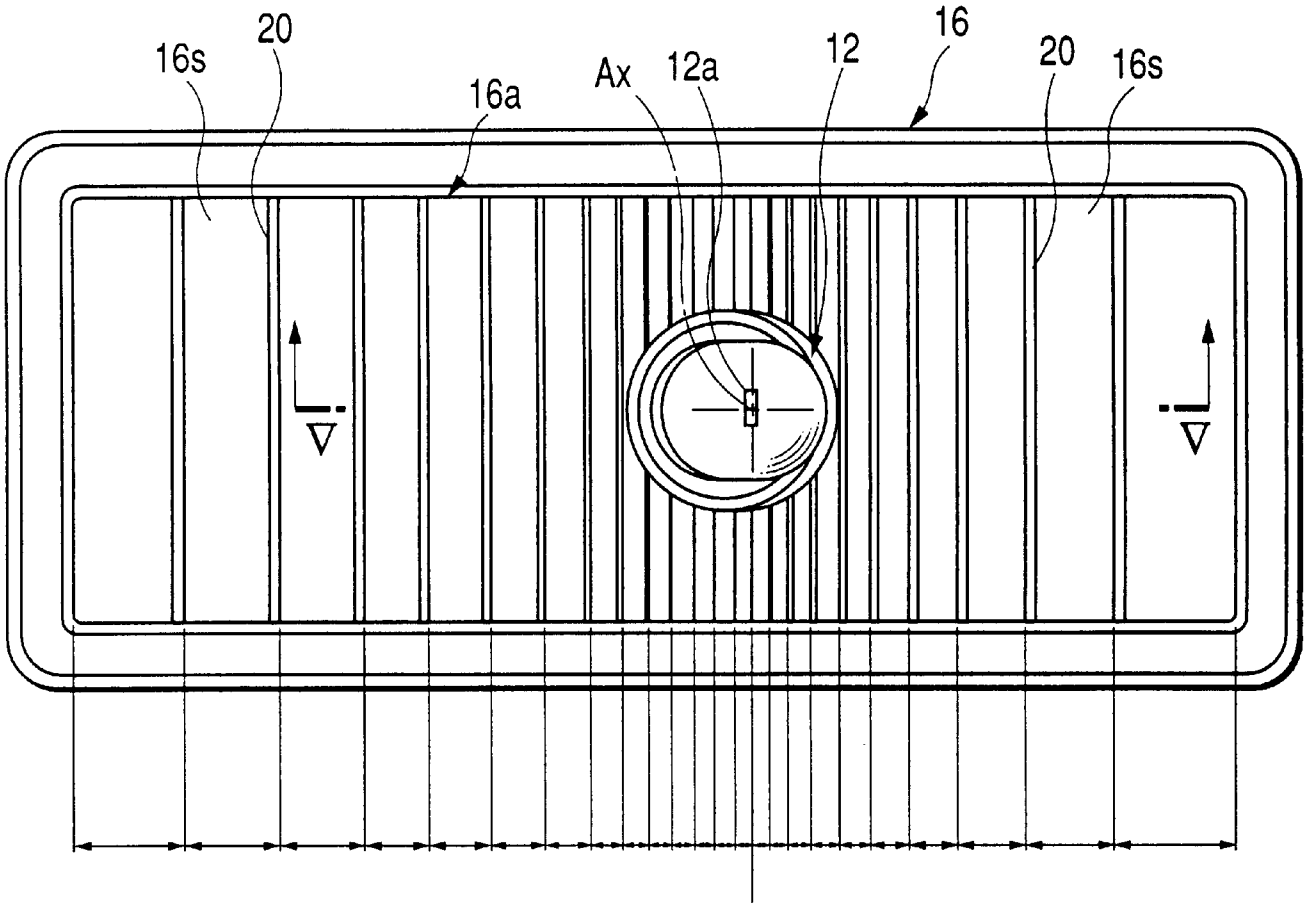
FIG. 4 is a front view of the vehicle signal lamp with its lens removed.

FIG. 4 is a front view of the above-described marker lamp 10 with its lens 18 removed.

As shown in FIG. 4, the reflector 16 is made up of a plurality of reflective surface elements 16*s* which are arranged over the whole reflective surface 16*a*. Those reflective surface elements 16*s* are divided like vertical stripes through steps 20.

In a front view of the lamp, the horizontal width of each of the reflective surface elements 16 is gradually smaller towards the optical axis Ax of the reflective surface 16 both in the right and left regions of the optical axis Ax.

Figure 5:
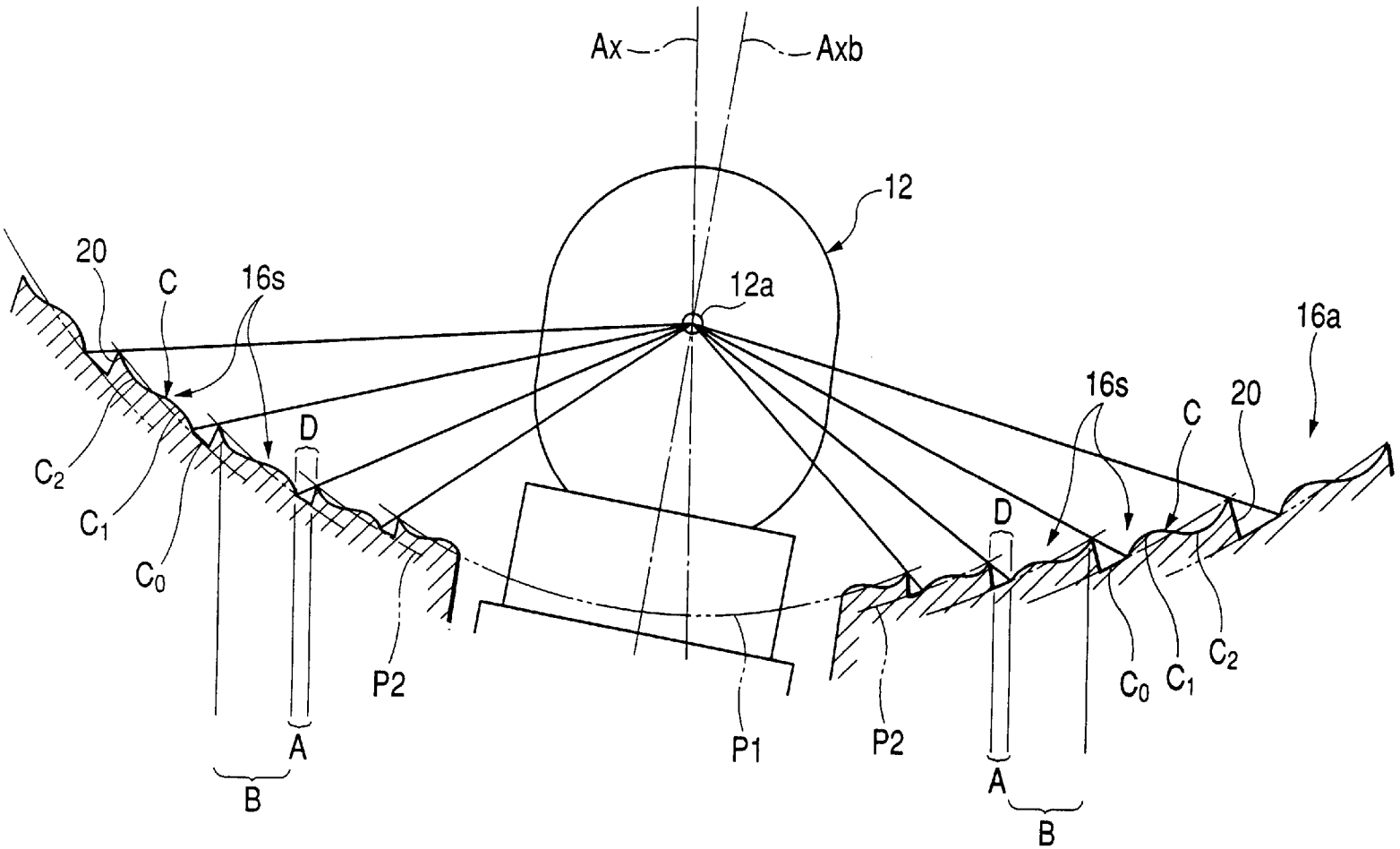
FIG. 5 is a sectional view taken along line V—V in FIG. 4.

Each of the reflective surface elements 16*s* is a horizontal diffusion reflective surface element with a so-called multiplex parabolic surface as a reference surface. As shown in FIG. 5, which is a sectional view taken along line V—V in FIG. 4, the reflective surface elements 16 are made up of a compound curved surface C which is formed with the rotational paraboloids P1, P2 as reference surfaces in which the optical axis Ax is employed as a common axial line and the intersection of the optical axis Ax and the optical axis Axb of the light source bulb 12 is employed as a common focal point, and the focal lengths are different (described later).

In order to reduce the thickness of the reflector 16, the focal lengths of the rotational paraboloids P1 and P2 are gradually smaller towards the aforementioned optical axis Ax of the reflective surface 16*a* in the right and left regions of the optical axis Ax. Hence, the aforementioned steps 20 extend towards the optical axis Ax. Accordingly, each of the reflective surface elements 16*s* has a light non-incidence section A to which the light from the light source bulb 12 (its filament 12*a*) is not applied because it is intercepted by the step 20 adjacent thereto on the side of the optical axis Ax of the reflective surface element 16*s*, and a light incidence section B to which the light from the light source bulb 12 is applied.

As was described above, the reflective surface elements 16*s* are made up of the compound curved surfaces C. A concrete example of the compound curved surfaces C is as follows: That is, the light non-incidence section A is the curved surface Co which is as the above-described reference surface, while the light incidence section B is made up of a convex cylindrical curved surface C1 which is convex in horizontal section and extended vertically, and a concave cylindrical curved surface C2 which is concave in horizontal section and extended vertically. Those cylindrical curved surfaces C1 and C2 are arranged horizontally and smoothly connected to one another.

Figure 6:
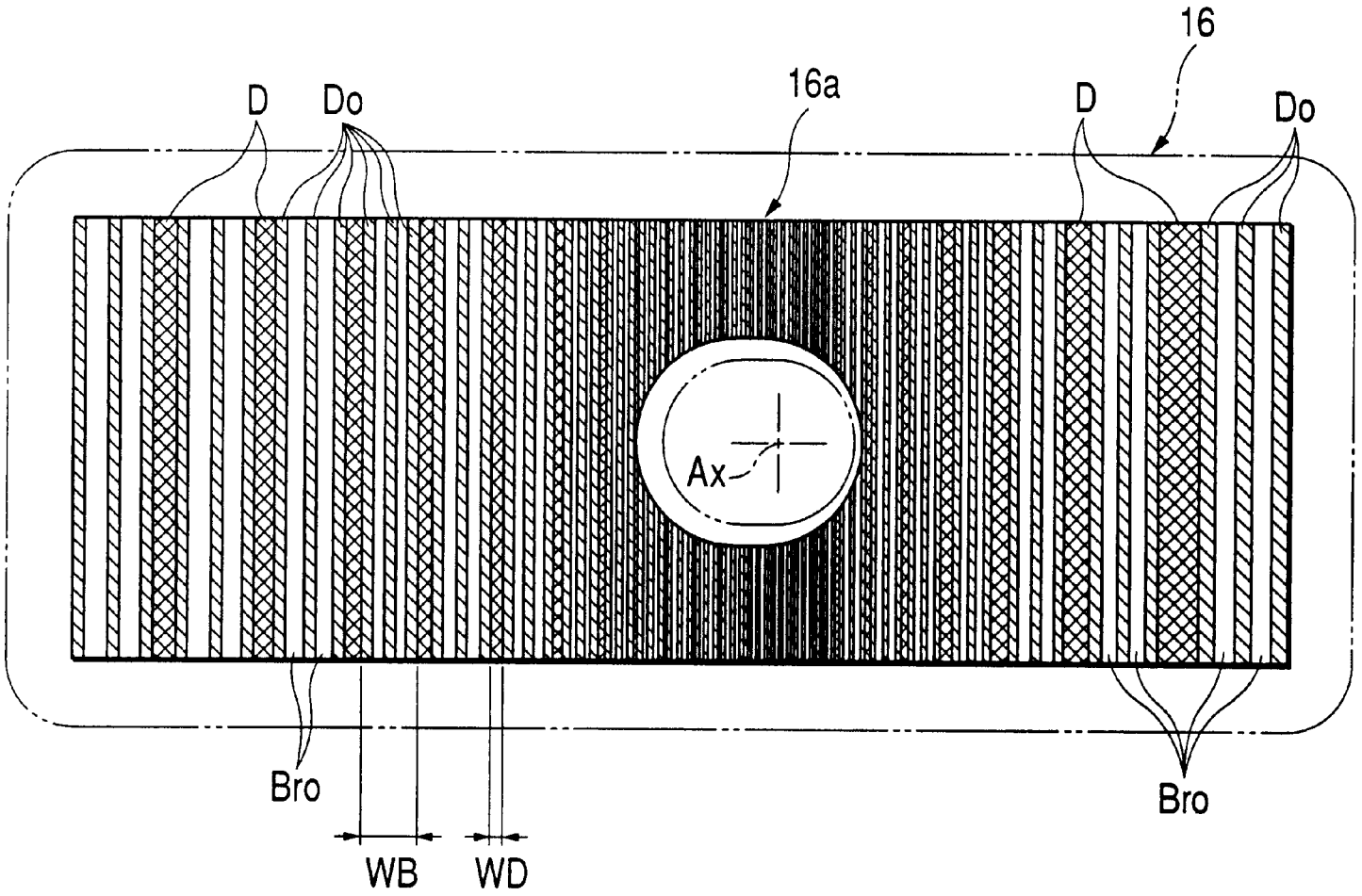
FIG. 6 is a front view of a reflective surface observed when the light source bulb is turned on with the lens of the vehicle signal lamp removed.

FIG. 6 is a front view of the lamp showing the appearance of the reflective surface 16*a* with the lamp turned on.

In FIG. 6, the regions D indicated by the net lines are shaded portions appearing dark, corresponding to the steps 20 and the light non-incidence sections A, and the remaining regions are the light incidence sections B. Of the light incidence sections B, the blank regions Bro are bright sections which look glittered when the lamp is observed from the front; and the regions Do indicated by the oblique lines are non-bright sections which do not glitter because the light from the light source bulb 12 is not reflected in the direction of the optical axis Ax. The non-bright sections Do are somewhat brighter than the shaded sections D.

As shown in the figure, the horizontal width WB of each light incidence section B and the horizontal width WD of each shaded section D are gradually increased as they come away from the optical axis Ax. This feature is obtained by gradually increasing the horizontal width of each reflective surface elements 16*s* as it comes away from the optical axis Ax, and by increasing the heights, in the direction of the optical axis Ax, of the steps 20 as they come away from the optical axis Ax. The adjustment of the heights of those step 20 is achieved by the adjustment of the focal lengths of the above-described rotational paraboloids P1 and P2.

Each of the light incidence sections B is made up of the convex cylindrical curved surface C1 and the concave cylindrical curved surface C2 which have a horizontal diffusion function. Therefore, when the lamp is turned on, owing to the light reflected from the light incidence section B the apexes of the cylindrical curved surfaces C1 and C2 look bright as the bright sections Bro. The horizontal width of each of those bright sections Bro is as follows: Since the horizontal width WB of each light incidence section B is gradually larger as it comes away from the optical axis Ax, the aforementioned horizontal width is larger as it comes away from the optical axis Ax; and the horizontal distance between a pair of adjacent bright sections Bro is larger as they come away from the optical axis Ax.

Figure 7:
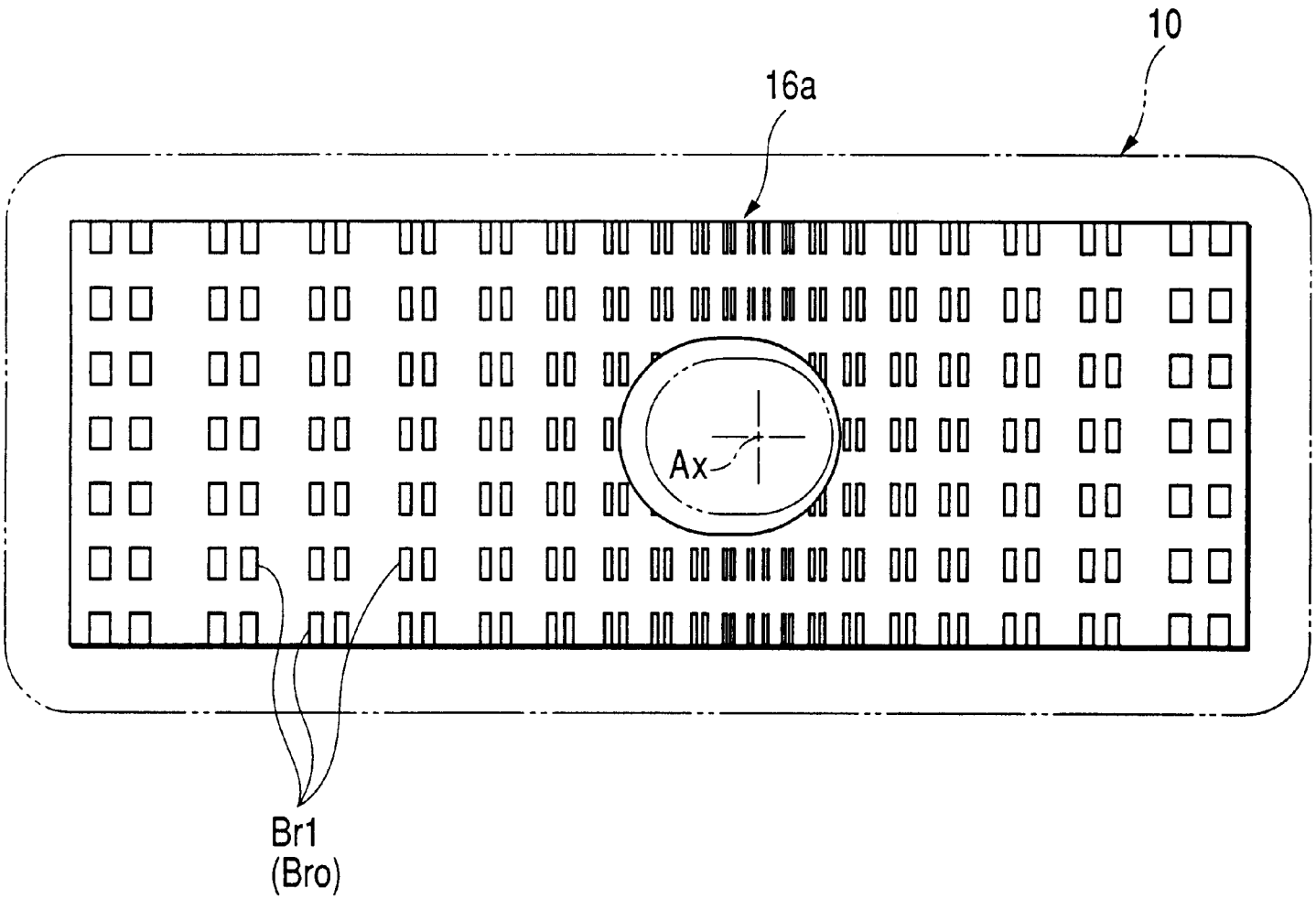

FIG. 7 shows a front view of the bright sections Bro when the light source bulb 12 is turned on with the reflector 16 covered with the lens 18 (the lamp 10 being used normally).

Each of the lens steps 18*s* has a vertical diffusion function. Therefore, the bright sections Bro of the reflective surface elements 16*s* are vertically spaced by the lens steps 18*s*, and look as bright sections Br1 which glitter in a scattering mode as shown. In this case, since the lens step 18*s* is formed vertically at equal intervals, the bright sections Br1 are formed vertically at equal intervals.

The diffusion lens steps 18*s* has no horizontal diffusion function, and therefore each of the bright section Br1 is gradually larger in horizontal width as comes apart from the optical axis Ax, and the horizontal distance between a pair of adjacent bright sections Bro is gradually larger as the latter comes apart from the optical axis. This is the same as the pattern of the bright sections Bro in the case where the lens 18 is not mounted yet.

As was described above, in the vehicle signal lamp 10 according to the embodiment, the reflective surface 16*a* of the reflector 16 is divided into a plurality of vertically elongated reflective surface elements 16*s* through the steps 20, and, in each of the reflective surface elements 16*s*, the light incidence section B to which the output light beam of he light source bulb 12 is applied is made up of the convex cylindrical curved surface C1 and the concave cylindrical curved surface which are arranged substantially in parallel with the step 20 adjacent to the light incidence section B.

Therefore, when the reflector 16 is observed from the front after the lamp is turned on, the light incidence sections B look as follows; that is, the apexes of the cylindrical curved surfaces C1 and C2 look bright as the bright sections Bro. Owing to this feature, the distance between the bright sections Bro of the reflective surface 16*a* can be decreased; that is, the reflective surface 16*a* can be sufficiently made bright and glitter. Not only the case where the lamp is observed from the front, but also it is observed obliquely, the reflective surface glitters.

Hence, according to the embodiment, the marker lamp with the step reflector looks attractive when turned on.

The bright sections Bro of the cylindrical curved surfaces C1 and C2 look glitter as a repetitive pattern over the whole reflective surface element. Therefore, the marker lamp look more attractive when turned on. Furthermore, when the lamp is turned on, the shaded portions D formed by the steps 20 are emphasized in configuration by the bright sections Bro, and therefore the reflective surface 16*a* is made more attractive in design by the shaded portions D.

When the lamp is observed in different directions, the distance between the bright section Bro of the convex cylindrical curved surface C1 and the bright section Bro of the concave cylindrical curved surface C2 changes, so that the lamp appears a novel one.

Furthermore, the convex cylindrical curved surface C1 is smoothly connected to the concave cylindrical curved surface C2, and therefore, when the lamp is not turned on, the light incidence sections B look integral. Hence, the lamp looks more attractive when not turned on.

Each of the light incidence sections B are gradually larger in width as it comes away from the optical axis Ax of the reflector 16, and accordingly, the horizontal distance between the pair of bright sections Bro and the horizontal distance of each of the bright sections Bro are gradually larger as it comes apart from the optical axis Ax. Therefore, because of the linear perspective drawing, the part of the reflective surface 16*a* which is near the optical axis Ax appears farthest; that is, it look gradually nearer as it comes apart from it. Hence, the reflective surface 16*a* looks deeper than its actual depth; this means that the lamp looks more attractive. Furthermore, the shaded portion formed between the light incidence sections B is gradually larger in width as it comes apart from the optical axis Ax. Therefore, the above-described effect of perspective drawing is similarly obtained.

Figure 8A:
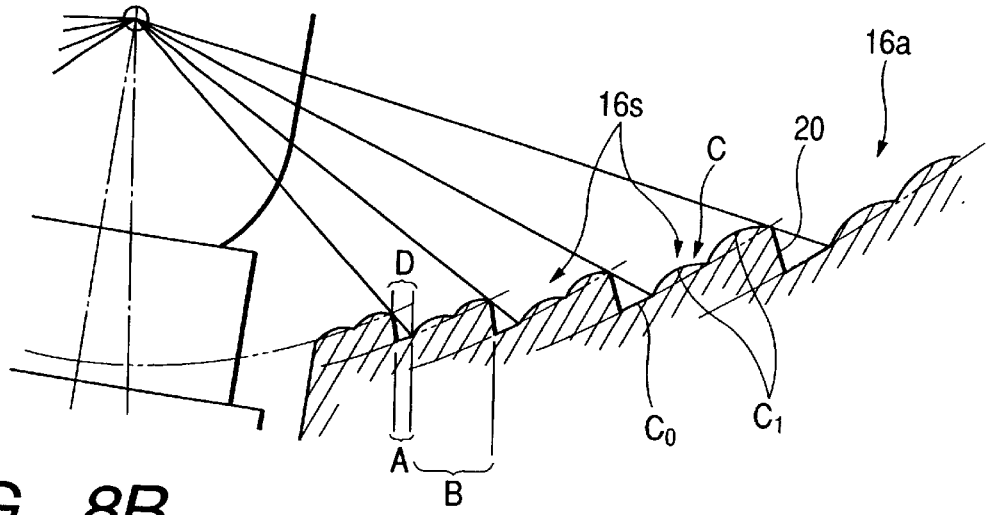
FIGS. 8A, 8B and 8C are diagrams, corresponding to FIG. 5, showing first, second and third modifications of the vehicle signal lamp of the invention.
Figure 8B:
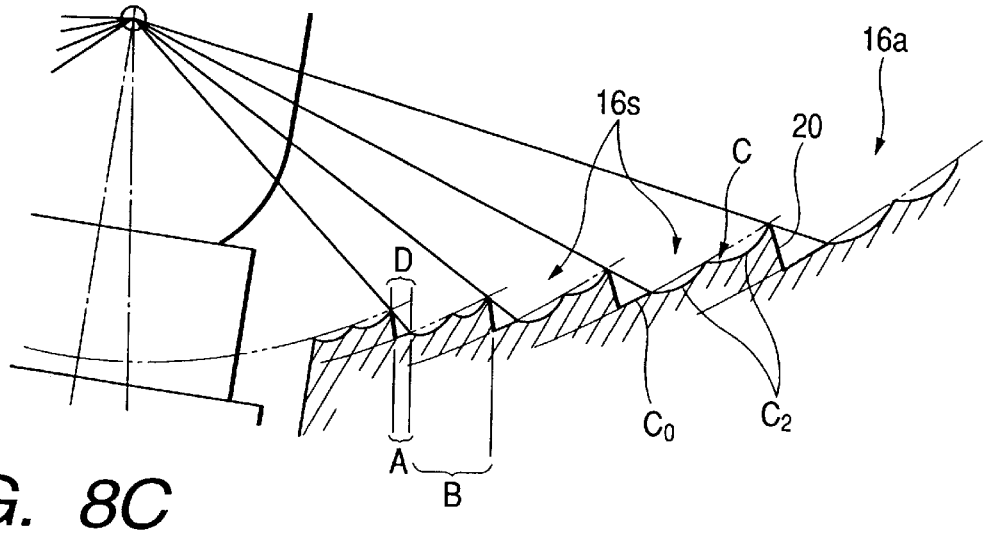
Figure 8C:
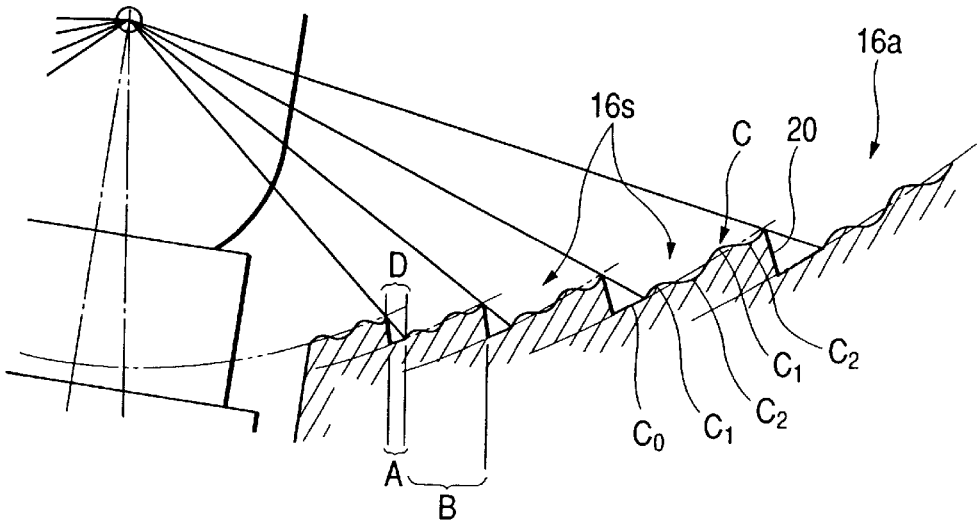
Figure 9:
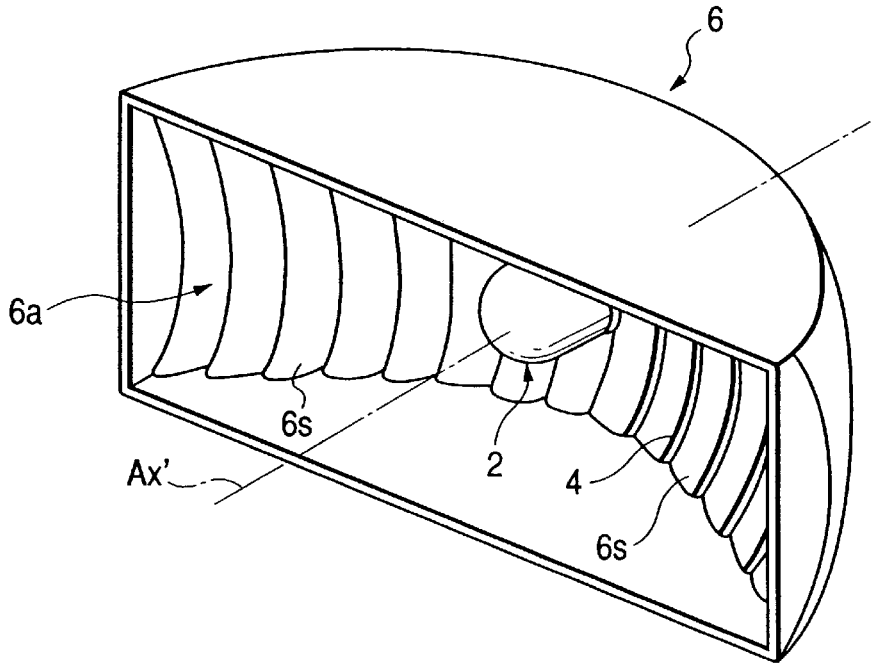
FIG. 9 PRIOR ART
FIG. 9 is a perspective view of the reflector of a conventional vehicle signal lamp.
Figure 10:
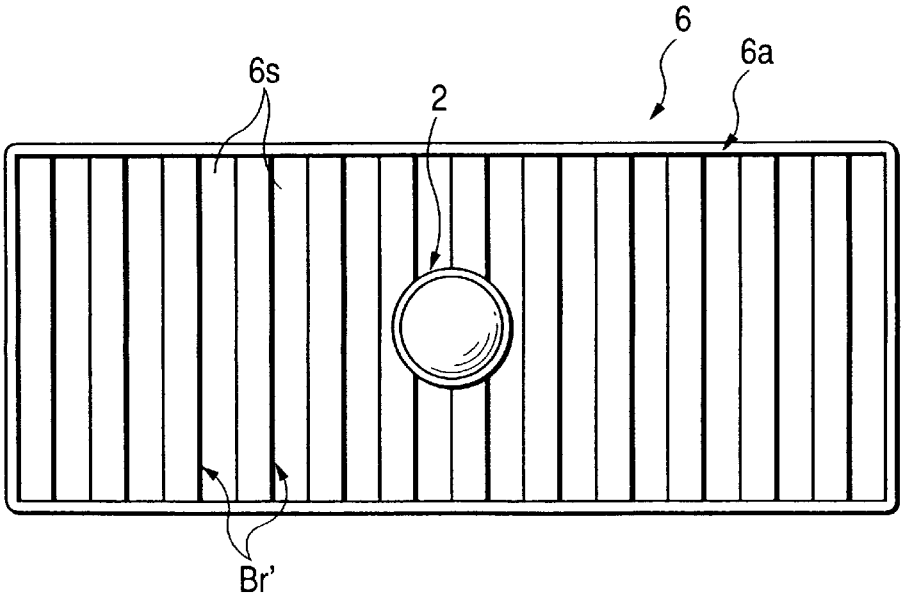
FIG. 10 PRIOR ART
FIG. 10 is a diagram, corresponding to FIG. 6, showing the conventional vehicle signal lamp.

FIGS. 8A, 8B and 8C are diagrams showing modifications of the above-described embodiment.

In the above-described embodiment, the light incidence section B is made up of the convex cylindrical curved surface C1 and the concave cylindrical curve surface C2 which are arranged substantially in parallel with the step 20 adjacent to the light incidence section B. However, as shown in a first modification shown in FIG. 8A, only the convex cylindrical curves surfaces C1 may be arranged in parallel, or as shown in a second modification shown in FIG. 8B, only the concave cylindrical curves may be arranged in parallel. Those modifications are able to obtain the same effects as the above-described embodiment. Furthermore, as in the case of a third modification shown in FIG. 8C a plurality of pairs of convex cylindrical curved surfaces C1 and concave cylindrical curved surfaces C2 are formed thereby to form the light incidence section B. In the modification, the reflective surface 16*a* looks more glitter, and the lamp is more attractive when turned on.

What is claimed is:

1. A vehicle lamp comprising:

a light source bulb; and a reflector including a reflective surface for reflecting light from said light source bulb, at least a part of said reflective surface is divided into a plurality of reflective surface elements by steps disposed therebetween, each of said reflective surface elements comprising a light incidence section to which light emitted from said light source bulb is applied, and said light incidence section being constituted by at least two curved surfaces.

2. A vehicle signal lamp as claimed in claim 1, wherein said curved surfaces are arranged substantially in parallel with said step adjacent to said light incidence section.

3. A vehicle signal lamp as claimed in claim 1, wherein each of said curved surfaces comprises a convex curved surface and a concave curved surface.

4. A vehicle signal lamp as claimed in claim 1, wherein each of said curved surfaces comprises two convex curved surfaces.

5. A vehicle signal lamp as claimed in claim 1, wherein each of said curved surfaces comprises two concave curved surfaces.

6. A vehicle signal lamp as claimed in claim 1, wherein each of said light incidence sections is gradually larger in width as said light incidence section is located away from the optical axis of said reflector.

7. A vehicle signal lamp as claimed in claim 1, wherein each of shaded portions formed between said light incidence sections is gradually larger in width as said shaded portion is located away from the optical axis of said reflector.

8. A vehicle signal lamp as claimed in claim 1, wherein said reflective surface elements are formed on a part of said reflective surface.

9. A vehicle signal lamp as claimed in claim 1, wherein the steps are formed so as to rise toward the optical axis.

10. A vehicle signal lamp as claimed in claim 1, wherein said reflective surface elements are formed on an entire surface of said reflective surface.

11. A vehicle signal lamp as claimed in claim 1, wherein the steps are formed so as to rise away from the optical axis.

12. A vehicle signal lamp as claimed in claim 1, wherein said reflective surface is divided into a matrix, and each of said reflective surface elements is rectangularly shaped.

13. A vehicle signal lamp as claimed in claim 1, wherein said reflective surface is divided into stripes, and each of said reflective surface elements is belt-shaped.

14. A vehicle signal lamp as claimed in claim 1, wherein said reflective surface is divided coaxially, and each of said reflective surface elements is in the form of loop.

15. A vehicle lamp as claimed in claim 1, wherein the width of said reflective surface elements is of a constant pitch.

16. A vehicle lamp as claimed in claim 1, wherein the width of said reflective surface elements is of a gradually changing pitch.

17. A vehicle lamp as claimed in claim 1, wherein the width of said reflective surface elements is of a random pitch.

18. A vehicle lamp as claimed in claim 1, wherein said steps prevents reflection of said light from a small portion of the reflective surface element that is directly adjacent thereto.

19. A vehicle lamp as claimed in claim 1, wherein said steps create a shaded portion of the reflected light and the light incidence sections are emphasized by said shaded portion.

20. A vehicle lamp as claimed in claim 1, wherein the curved surfaces of said light incidence section are curved when viewed from a section of said lamp, the section being parallel to an optical axis of said reflector and vertical to edges of the steps.

* * * * *